US010308409B2

(12) United States Patent
Stuart et al.

(10) Patent No.: US 10,308,409 B2
(45) Date of Patent: Jun. 4, 2019

(54) CUSTOMIZABLE CADDY

(71) Applicant: DEFLECTO, LLC, Indianapolis, IN (US)

(72) Inventors: Christopher Stuart, Noblesville, IN (US); Danielle N. Rodgers, Indianapolis, IN (US); James DeChant, Carmel, IN (US); Patrick Foley, Fishers, IN (US); Cyril Bennett, Indianapolis, IN (US)

(73) Assignee: DEFLECTO, LLC, Indianapolis, IN (US)

( * ) Notice: Subject to any disclaimer, the term of this patent is extended or adjusted under 35 U.S.C. 154(b) by 510 days.

(21) Appl. No.: 14/987,483

(22) Filed: Jan. 4, 2016

(65) Prior Publication Data

US 2016/0194115 A1 Jul. 7, 2016

Related U.S. Application Data

(60) Provisional application No. 62/099,877, filed on Jan. 5, 2015.

(51) Int. Cl.

| | |
|---|---|
| ***B65D 25/04*** | (2006.01) |
| ***B65D 71/52*** | (2006.01) |
| ***B25H 3/06*** | (2006.01) |
| ***B65D 21/02*** | (2006.01) |

(52) U.S. Cl.

CPC ..... *B65D 71/0003* (2013.01); *B25H 3/06* (2013.01); *B65D 21/0212* (2013.01)

(58) Field of Classification Search

CPC ..... B65D 25/04; B65D 25/2802; B65D 71/0003; B65D 71/0014; B65D 21/0212; B65D 21/0226; B65D 1/36; B65D 5/46; B65D 5/46008; B65D 5/46016; B65D 5/46024; B65D 5/4604; B65D 23/108; B65D 25/2811; B65D 25/282; B65D 25/2823; B65D 25/2841; B65D 25/2867; B65D 25/2888; B65D 25/32; B65D 25/325; B25H 3/06; A45C 11/20; A45C 1/28; A45C 1/26

USPC ..... 220/554; 206/503, 510

See application file for complete search history.

(56) References Cited

U.S. PATENT DOCUMENTS

| | | | | |
|---|---|---|---|---|
| 532,324 A * | 1/1895 | Kolb | B65D 71/0003 206/174 |
| 3,333,730 A | 8/1967 | Zarlinski et al. | |
| 3,349,958 A | 10/1967 | Breneman et al. | |
| 4,364,150 A * | 12/1982 | Remington | A45C 13/26 16/409 |
| 4,505,506 A * | 3/1985 | Picozza | A45F 3/46 294/161 |

(Continued)

FOREIGN PATENT DOCUMENTS

| | | |
|---|---|---|
| DE | 3702061 | 8/1987 |
| DE | 3702061 Al | 8/1987 |

OTHER PUBLICATIONS

European Search Report dated Jul. 25, 2018 in related Application No. 16735280.6 filed Jan. 5, 2016 (5 pages).

*Primary Examiner* — Robert Poon

(74) *Attorney, Agent, or Firm* — Barnes & Thornburg LLP

(57) ABSTRACT

A storage system including a storage base that includes a frame, a partition dividing the frame into first and second compartments where each of the first and second compartments includes a cavity formed therein with at least an open top and the partition wall includes an upper portion extending above the level of the frame to form a handle.

6 Claims, 7 Drawing Sheets

(56) References Cited

U.S. PATENT DOCUMENTS 4,714,158 A 12/1987 Oltman et al.
5,415,277 A * 5/1995 Berntsen ..... B65D 21/0212 206/144
5,423,445 A * 6/1995 Montanari ..... B65D 25/22 206/506
5,609,282 A * 3/1997 Melanson ..... A45F 5/02 206/338
5,904,388 A * 5/1999 Seibel ..... A45C 13/28 294/141
6,059,109 A * 5/2000 Stein ..... B25H 3/06 206/373
7,559,514 B1 7/2009 Wynter
8,636,169 B2 * 1/2014 Sampaio ..... B65D 25/2891 200/555
2002/0179462 A1 * 12/2002 Silvers ..... B65D 1/36 206/233
2006/0157373 A1 7/2006 Griffith
2008/0000899 A1 1/2008 Baker
2009/0255092 A1 * 10/2009 Huang ..... A45F 5/10 16/405
2010/0176022 A1 * 7/2010 Furlong ..... A47J 47/10 206/508
2013/0021787 A1 * 1/2013 Noble ..... F21V 33/0084 362/156
2014/0311926 A1 * 10/2014 Walters ..... A45C 11/00 206/19
2015/0021322 A1 * 1/2015 Rosenblum ..... B65D 21/0223 220/23.89
2016/0130034 A1 * 5/2016 Kuhls ..... B25H 3/023 206/510

* cited by examiner

CUSTOMIZABLE CADDY

RELATED APPLICATION DATA

The present application claims priority to U.S. provisional application 62/099,877 filed in the United States Patent Office on Jan. 5, 2015, the entirety of which is hereby incorporated by reference to the extent permitted by law.

FIELD OF THE INVENTION

The present invention relates to a container system that includes a portable carrying base configured to receive interchangeable storage receptacles. One or more individual container systems can be combined to create a larger organizational unit.

BACKGROUND OF THE INVENTION

Storing items such as office or craft supply items can be difficult with current storage systems. This is because known storage solutions do not offer the flexibility to interchange storage receptacles or easily stack and carry more than one storage solution.

SUMMARY OF THE INVENTION

Disclosed herein are storage systems including a storage base. The storage base includes a frame including (i) a first horizontal side wall facing a second horizontal side wall, (ii) a first horizontal end wall facing a second horizontal end wall, the first and second horizontal end walls extending transversely between the first and second horizontal side walls, a partition extending transversely between the horizontal end walls to divide the frame into first and second compartments. The first and second compartments including (a) a planar bottom, (b) a first vertical side wall extending up from the planar bottom and terminating at a top edge, the top edge coupled to the first horizontal end wall, (c) a second vertical side wall facing the first vertical side wall extending up from the planar bottom and terminating at a top edge, the top edge coupled to the second horizontal end wall and a cavity formed within the planar bottom and vertical side walls of each compartment, each cavity at least having an open top bounded by the top edges of the horizontal end walls, the partition and one of the horizontal side walls. Further, the partition wall includes an upper portion extending above the level of the frame to form a handle, and the handle further includes (a) first handle portion pivotally attached to a first end of the handle, (b) a second handle portion pivotally attached to a second end of the handle, (c) and a groove configured to receive the handle portions therein.

In another embodiment of the invention, the horizontal end walls include an opening, and each handle portion has a projecting edge configured to mate with the opening within the horizontal end walls.

In another embodiment of the invention, the container system includes a first and second storage base, where the handle portions of the first storage base are mated with the corresponding opening within the horizontal end walls of the second storage base so as to removably connect the first storage base to the second storage base and create a storage unit.

In another embodiment of the invention, the horizontal side walls, horizontal end walls, partition, planar bottom and vertical end walls being integral to form a one piece, rigid base.

In another embodiment of the invention, the container system includes a removable receptacle configured to be received within at least a portion of the cavities, the receptacle comprising (a) a planar bottom with side walls coupled to the outward peripheral edges of the planar bottom to form a rectangular shape, and (b) a cap in substantially the same shape as the planar bottom configured to be received by the top edges of the side walls to create an enclosed receptacle.

In another embodiment of the invention, the container system includes a plurality of removable receptacles.

In another embodiment of the invention, the container system includes differently sized removable receptacles.

In another embodiment of the invention, planar bottoms include a receptacle connection structure comprising at least one raised portion on the upper surface of the planar bottom configured to mate with a recessed portion on the lower surface of the receptacle planar bottom, such that the receptacle removably connects to the planar bottom. A person of ordinary skill in the art would understand that this arrangement could be inverted to achieve the same result.

In another embodiment of the invention each planar bottom includes three receptacle connection structures evenly spaced across the planar bottom.

In another embodiment of the invention the cap includes a planar bottom connection structure comprising at least one recessed portion on the upper surface of the cap configured to mate with a raised portion on the lower surface of the planar bottom, such that the cap removably connects to the planar bottom. A person of ordinary skill in the art would understand that this arrangement could be inverted to achieve the same result.

In another embodiment of the invention each cap includes two planar bottom connection structures evenly spaced across the upper surface of the cap.

In another embodiment of the invention each cap includes three planar bottom connection structures evenly spaced across the upper surface of the cap.

In another embodiment of the invention the container system includes a first and second storage base, wherein the handle portions of the first storage base are mated with the corresponding opening within the horizontal end walls of the second storage base so as to removably connect the first storage base to the second storage base and the cap of the receptacle within the lower storage base is mated with the lower surface of the planar bottom of the second storage unit, such that first and second storage bases form a storage unit.

In another embodiment of the invention the first compartment and second compartment are formed so as to receive a handle of a second storage base when the second storage base is mated with the first storage base.

In another embodiment of the invention there is container system kit including a storage base comprising (a) a frame including (i) a first horizontal side wall facing a second horizontal side wall, (ii) a first horizontal end wall facing a second horizontal end wall, the first and second horizontal end walls extending transversely between the first and second horizontal side walls (b) a partition extending transversely between the horizontal end walls to divide the frame into first and second compartments, (c) each of the first and second compartments including (i) a planar bottom, (ii) a first vertical side wall extending up from the planar bottom and terminating at a top edge, the top edge coupled to the first horizontal end wall, (iii) a second vertical side wall facing the first vertical side wall extending up from the planar bottom and terminating at a top edge, the top edge coupled to the second horizontal end wall, and (d) a cavity formed within the planar bottom and vertical side walls of each compartment, each cavity at least having an open top bounded by the top edges of the horizontal end walls, the partition and one of the horizontal side walls and a removable receptacle configured to be received within at least a portion of the cavities, the receptacle comprising (a) a planar bottom with side walls coupled to the outward peripheral edges of the planar bottom to form a rectangular shape, and (b) a cap in substantially the same shape as the planar bottom configured to be received by the top edges of the side walls to create an enclosed receptacle. Further, the partition wall of the storage base includes an upper portion extending above the level of the frame to form a handle, and the handle further includes (a) first handle portion pivotally attached to a first end of the handle, (b) a second handle portion pivotally attached to a second end of the handle, (c) and a groove configured to receive the handle portions therein.

Numerous other aspects, features and benefits of the present disclosure may be made apparent from the following detailed description taken together with the drawing figures.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings.

DETAILED DESCRIPTION OF THE INVENTION

Figure 1:
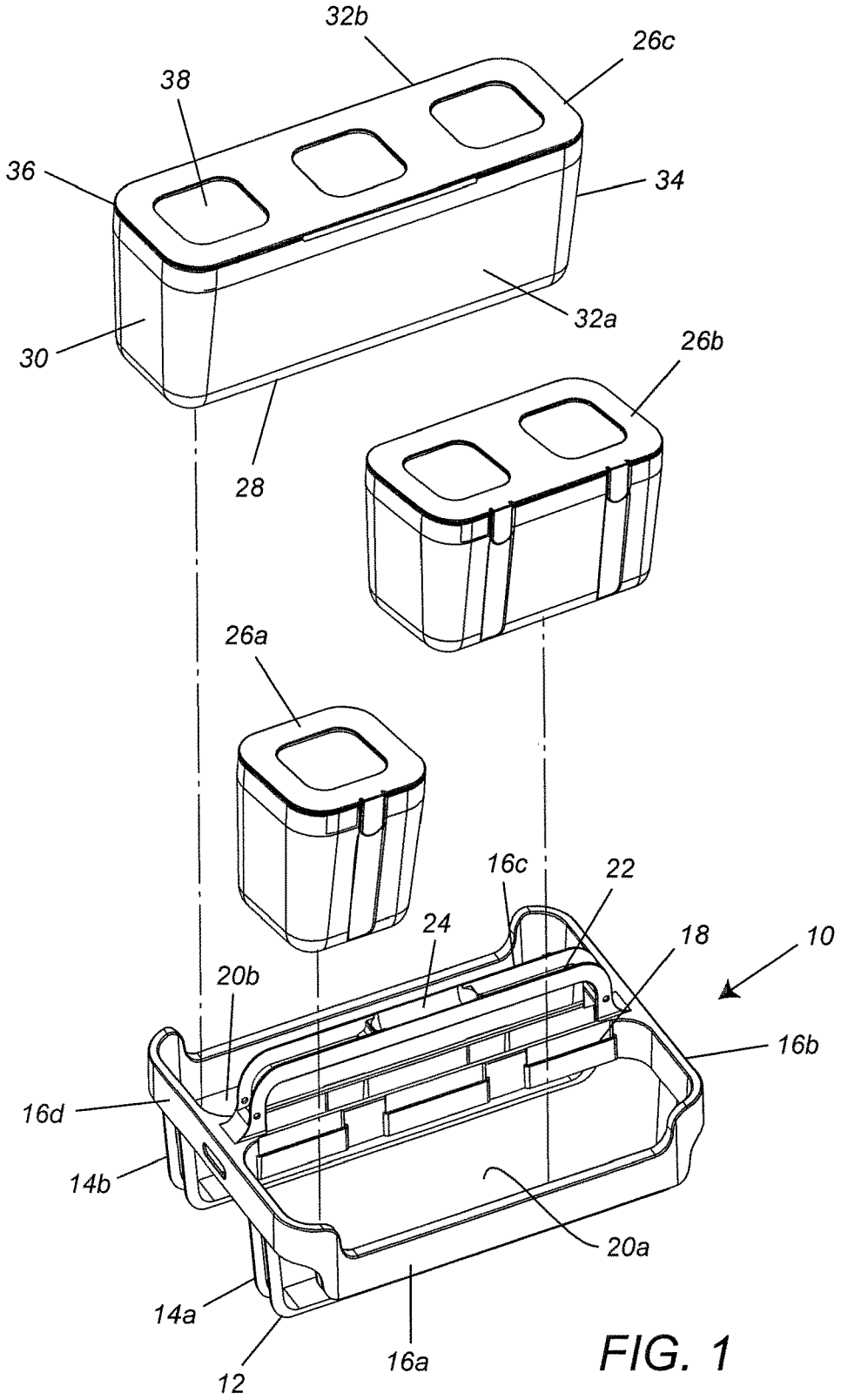
FIG. 1 depicts an exploded view of a carrying base and storage receptacles according to an embodiment of the invention.

As shown in FIG. 1 the container system includes a base portion 10. The base portion includes a planar bottom 12. The base portion includes a first end and a second end, each of which are coupled to a vertical side wall 14*a* and 14*b*. The vertical side wall 14 is coupled to horizontal side walls 16*a*, 16*b*, 16*c* and 16*d*, which define the internal space of the base portion 10. The base portion can assume various shapes known to persons of ordinary skill in the art by varying the length or other dimensions of the horizontal and vertical side walls, but is preferably square or rectangular in shape.

Further, as shown in FIG. 1, an interior horizontal sidewall 18 or sidewalls may used to separate or divide the interior of the base portion into one or more cavities 20. In the embodiment shown in FIG. 1, the base portion is divided into two cavities 20*a* and 20*b*. Each cavity is defined by a planar bottom 12, vertical side walls 14 and an horizontal interior side wall 16. The planar bottom 12, vertical side walls 14 and horizontal side walls 16 and 18 can vary in dimension so as to create a more open base portion as shown or closed cavity. In other embodiments, the cavities can further be defined into smaller cavities by employing additional interiors side walls within the cavity.

A handle 22 extends from a first horizontal side wall to second horizontal side wall opposite to or facing the first horizontal sidewall. The handle is provided to allow the container system to be moved to another location by grasping a portion of the bar 24. As discussed in more detail later on, the handle portion 44 also serves to connect one container system to another.

The container system also includes one or more receptacles 26 of the same or varying sizes like those shown in 26*a*, 26*b* and 26*c*. The receptacles can be inserted within the base portion to transport the receptacles or store the receptacles. The receptacles can also be removed to access items within the receptacle or interchange them with a different receptacle. Each receptacle includes a planar bottom 28 with walls coupled to outward peripheral edges of the planar bottom 28. Specifically, the receptacle may include a first side wall 32*a* that is coupled to one side edge of the planar bottom 28 and a second side wall 32*b* is coupled to the opposite side edge of the planar bottom. Between the sidewalls is a frontwall 30 that is coupled to a front edge of the planar bottom and a backwall 34 coupled to the opposite back edge of the planar bottom. The sidewalls, planar bottom and front and back walls combine to form a receptacle with an internal storage cavity.

Included with the receptacle 26 is a cap 36 which can be attached to an upper edge of a side wall, front wall or back wall to create an enclosed receptacle. For example, the cap can be provided with one or more hinge supports equally spaced along a peripheral edge of the cap which is joined to either a side wall, front wall or back wall. In the embodiment, the cap can open by pivoting about the hinge and close by pivoting about the hinge in an opposite direction. The cap can also snap into place on top of the receptacle. Other mechanisms of attaching the cap to the receptacle well known to those of ordinary skill in the art can also be employed. Further, the upper surface of the cap 36 may include one or more recesses 38 which have a peripheral profile that corresponds to all or a portion of the planar bottom 12 of the base portion 10, the planar bottom 28 of a different receptacle, or both such that when one or more organization units are vertically stacked, the planar bottom 12 of the base portion 10, the planar bottom 28 of a different receptacle, or both nest with in all or a portion of the cap recess.

Figure 2:
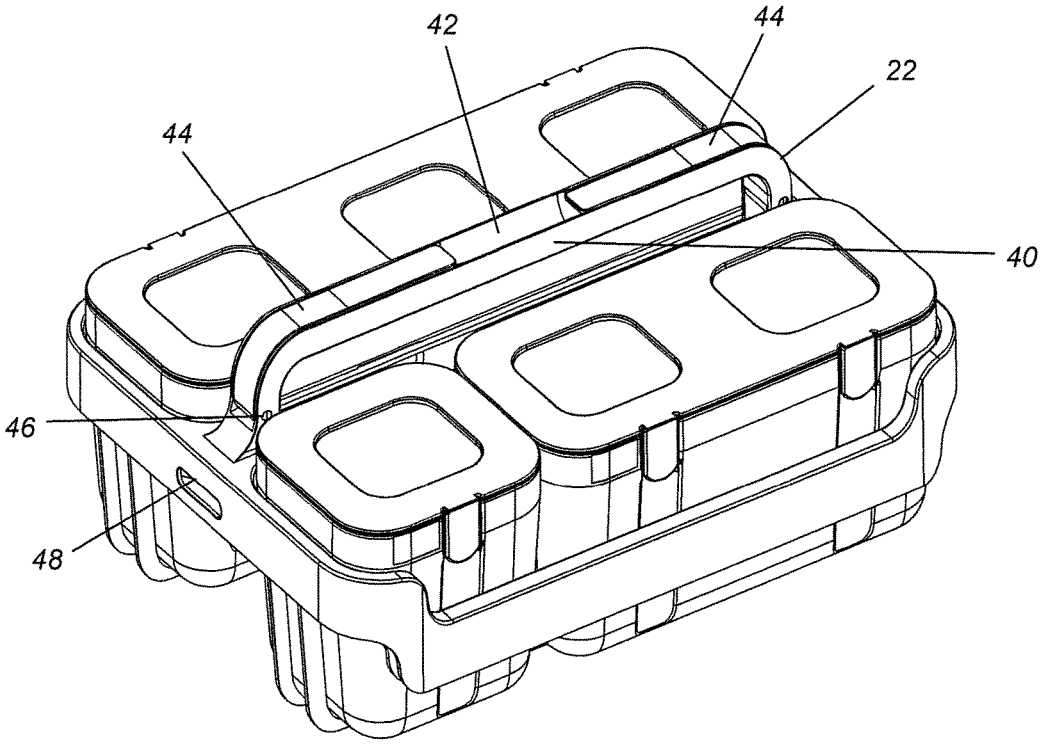
FIG. 2 depicts a view of a carrying base and storage receptacles according to an embodiment of the invention.

FIG. 2 is shows a more detailed view of the handle 22. The handle 22 may include a pair of handle side walls 40 facing each other forming a groove or open cavity 42 which can receive handle portion 44 that pivots about a fixed point 46 to a 90 degree or substantially 90 degree angle with respect to the handle 22. The handle portion 44 and the groove 42 are configured such that the upper surface of handle portion 44 is flush with the upper edges of the groove 42 when the handle portion is received within the groove. FIG. 2 also shows an opening 48 in horizontal side wall, which is adapted to receive the upper part of the handle portion as shown in FIGS. 3 and 4.

Figure 3:
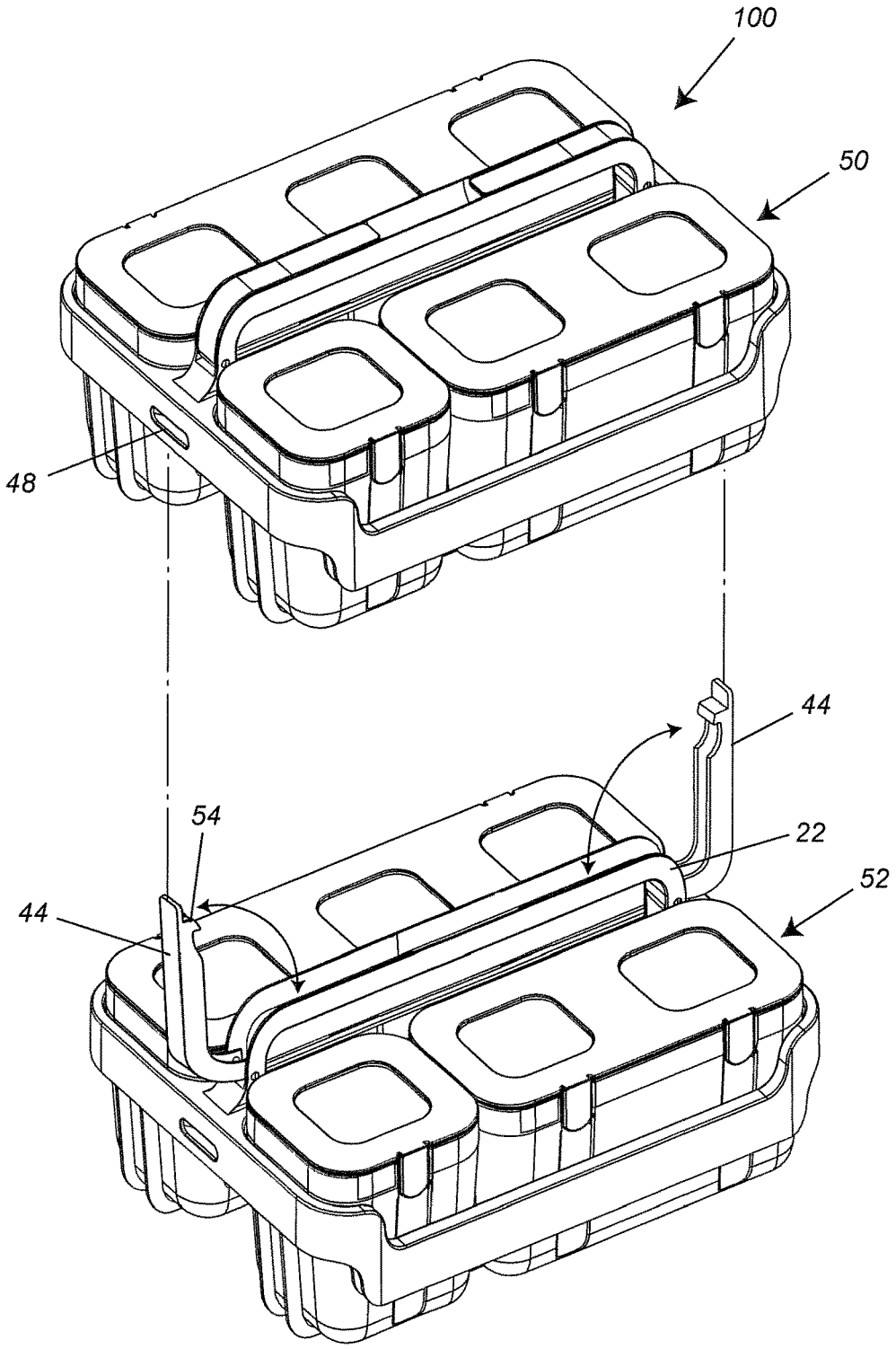
FIG. 3 depicts an exploded view of the organizational unit according to an embodiment of the invention.
Figure 4:
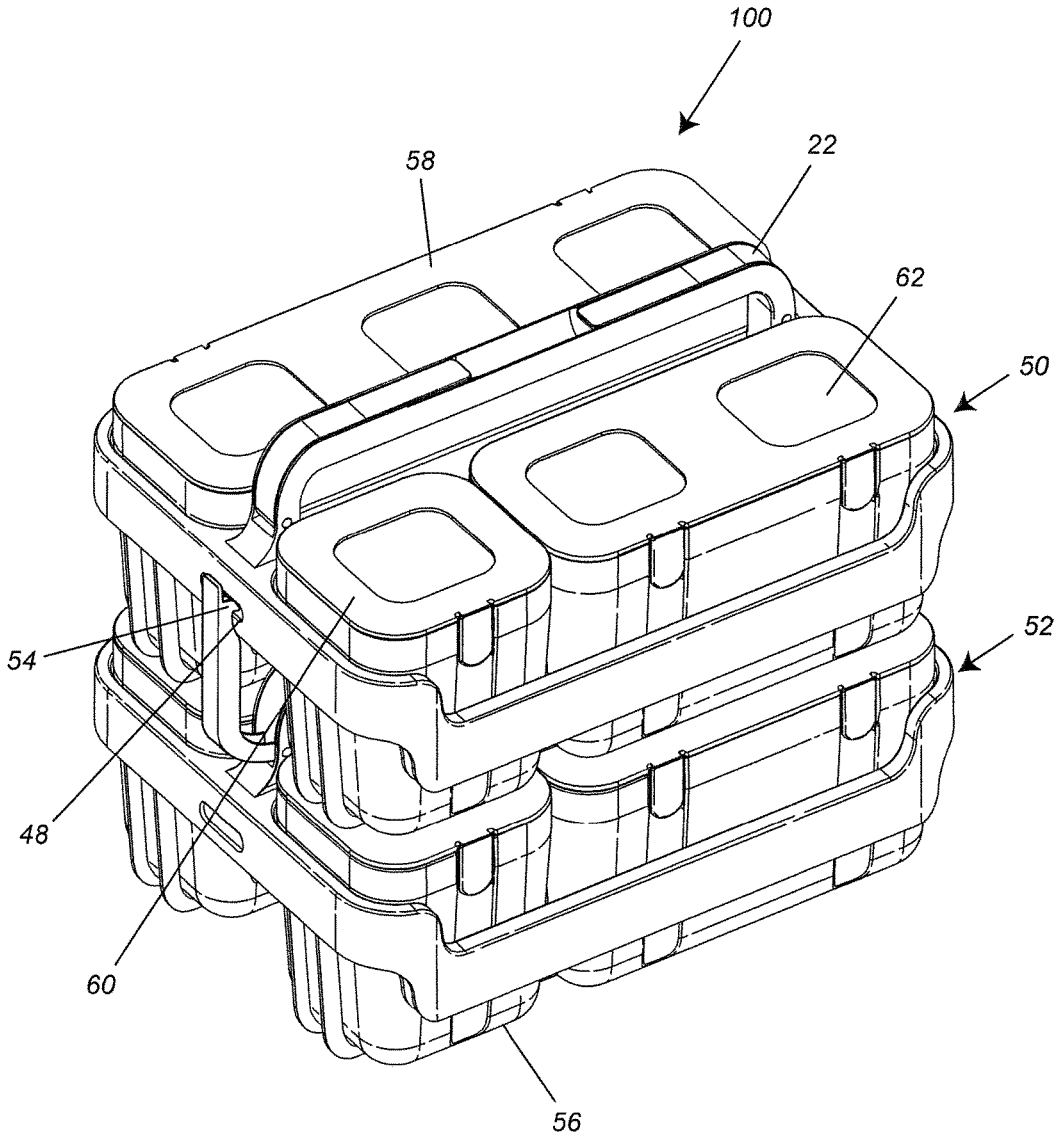
FIG. 4. depicts the organizational unit according to an embodiment of the invention.

FIGS. 3 and 4 show an embodiment of the invention where two or more container systems may be connected to each other to create an organization unit 100. Specifically, FIG. 3 shows an upper container system 50 disconnected from a lower container system 52 which allows a user to create a smaller organizational unit or to access receptacles within a lower container system 52.

In this embodiment, the handle portions 44 are extended outwardly from the handle 22 at about 90 degrees. Each handle portion has a projecting edge 54 which can be mated with the opening 48 within the horizontal side wall of the upper container system 50. When the projecting edges 54 are mated with a corresponding opening 48 of the upper container system, the container systems are securely connected and transportable using the handle of the upper container system 22 while the planar bottom 56 of the lower container system 52 serves as the base of the entire organizational unit. A person of ordinary skill in the art would understand that the organizational unit is not limited to only two container systems mated together and that two or more container systems can be mated together in order to create a large organizational unit. In this case, the handle 22 of the upper most container system permits a user to easily transport or carry the entire organizational unit while the planar bottom of the lower most container system serves as the base for the entire organizational unit.

Figure 5:
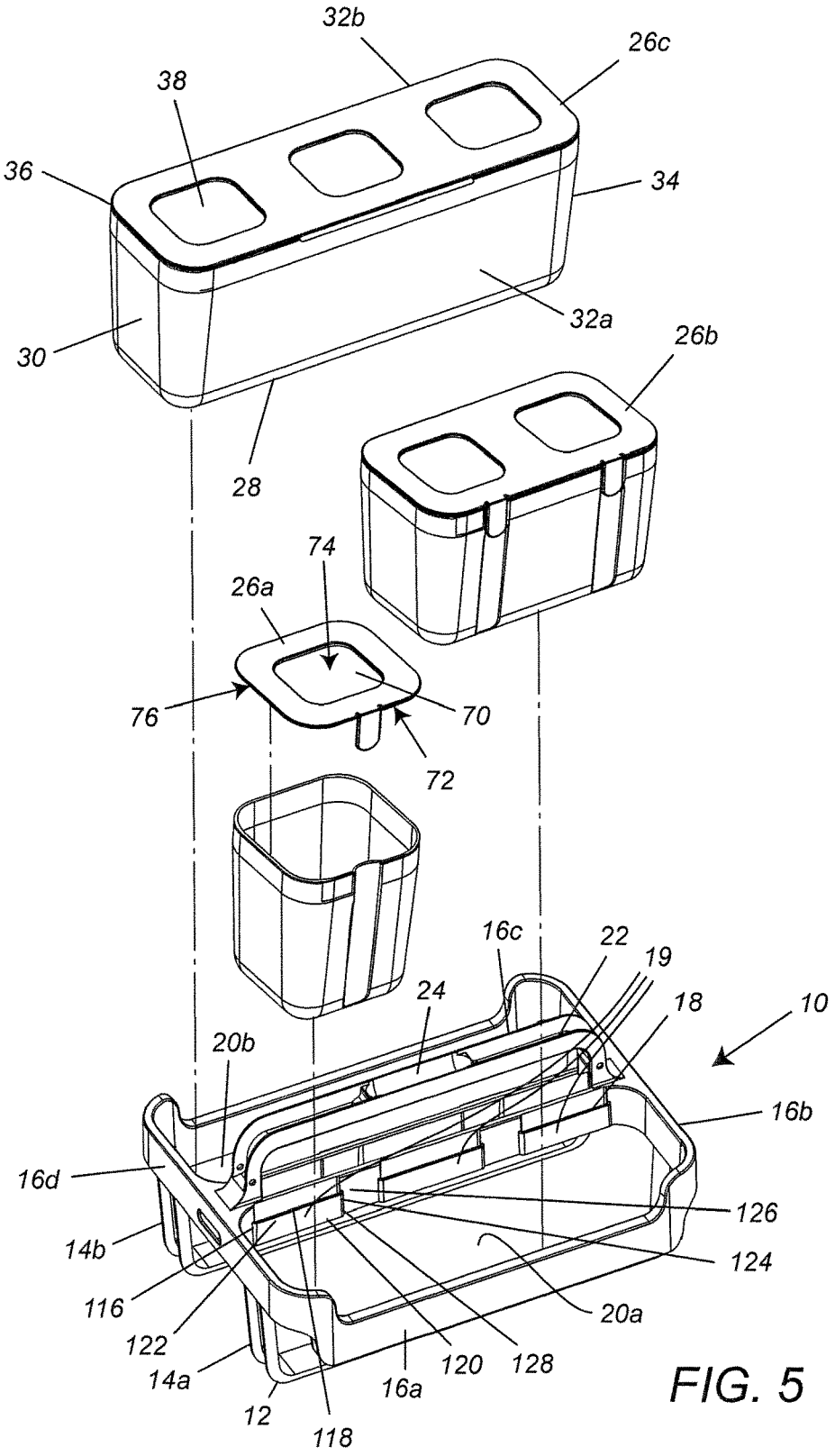
FIG. 5 depicts an exploded view of the organizational unit according to an embodiment of the invention.

As shown in FIG. 5 the container system includes a base portion 10. The base portion includes a planar bottom 12. The base portion includes a first end and a second end, each of which are coupled to a vertical side wall 14*a* and 14*b*. The vertical side wall 14 is coupled to horizontal side walls 16*a*, 16*b*, 16*c* and 16*d*, which define the internal space of the base portion 10. The base portion can assume various shapes known to persons of ordinary skill in the art by varying the length or other dimensions of the horizontal and vertical side walls, but is preferably square or rectangular in shape.

Further, as shown in FIG. 5, an interior horizontal sidewall 18 or sidewalls may used to separate or divide the interior of the base portion into one or more cavities 20. In the embodiment shown in FIG. 1, the base portion is divided into two cavities 20*a* and 20*b*. Each cavity is defined by a planar bottom 12, vertical side walls 14 and an horizontal interior side wall 16. The planar bottom 12, vertical side walls 14 and horizontal side walls 16 and 18 can vary in dimension so as to create a more open base portion as shown or closed cavity. In other embodiments, the cavities can further be defined into smaller cavities by employing additional interiors side walls within the cavity.

A handle 22 extends from a first horizontal side wall to second horizontal side wall opposite to or facing the first horizontal sidewall. The handle is provided to allow the container system to be moved to another location by grasping a portion of the bar 24. As discussed in more detail later on, the handle portion 44 also serves to connect one container system to another.

The container system also includes one or more receptacles 26 of the same or varying sizes like those shown in 26*a*, 26*b* and 26*c*. The receptacles can be inserted within the base portion to transport the receptacles or store the receptacles. The receptacles can also be removed to access items within the receptacle or interchange them with a different receptacle. Each receptacle includes a planar bottom 28 with walls coupled to outward peripheral edges of the planar bottom 28. Specifically, the receptacle may include a first side wall 32*a* that is coupled to one side edge of the planar bottom 28 and a second side wall 32*b* is coupled to the opposite side edge of the planar bottom. Between the sidewalls is a frontwall 30 that is coupled to a front edge of the planar bottom and a backwall 34 coupled to the opposite back edge of the planar bottom. The sidewalls, planar bottom and front and back walls combine to form a receptacle with an internal storage cavity.

Included with the receptacle 26 is a cap 36 which can be attached to an upper edge of a side wall, front wall or back wall to create an enclosed receptacle. In an embodiment, the cap 36 is configured to cover and seal the opening of the receptacle 26. The cap 36 includes a panel 70 with an upper surface 74 and a lower surface 72. An edge circumvents 76 the perimeter of the panel. In an embodiment, the edge 76 has an inner wall that extends perpendicularly or substantially perpendicular downward from the plane of the panel. The inner wall is coupled to an upper wall of the edge which extends horizontally and is coupled to an outer wall that extends vertically downward from the upper wall. The outer wall is spaced apart from the inner wall to form a channel (not shown). In an example, the cap fits over the receptacle so that the top edge of the receptacle is received within the channel of the lid. In this example, the cap covers the opening of the receptacle create a closed cavity. Further to this example, the cap can easily be removed to access the cavity within the receptacle. Other mechanisms of attaching the cap to the receptacle well known to those of ordinary skill in the art can also be employed. Further, the upper surface of the cap 36 may include one or more recesses 38 which have a peripheral profile that corresponds to all or a portion of the planar bottom 12 of the base portion 10, the planar bottom 28 of a different receptacle, or both such that when one or more organization units are vertically stacked, the planar bottom 12 of the base portion 10, the planar bottom 28 of a different receptacle, or both nest with in all or a portion of the cap recess.

Further, a person of ordinary skill in the art would understand that a kit could be created using various combinations of the components described above. For example a kit could include a base portion with three different sized receptacles 58, 60 and 62 that fit within the base unit cavities. Separate base units could be provided such that the combination of receptacles could vary. For example, three smaller receptacles may be placed within one cavity of the base portion, or each base portion could include only one receptacle that extends the entire length and width of the cavity, 62.

Figure 6A:
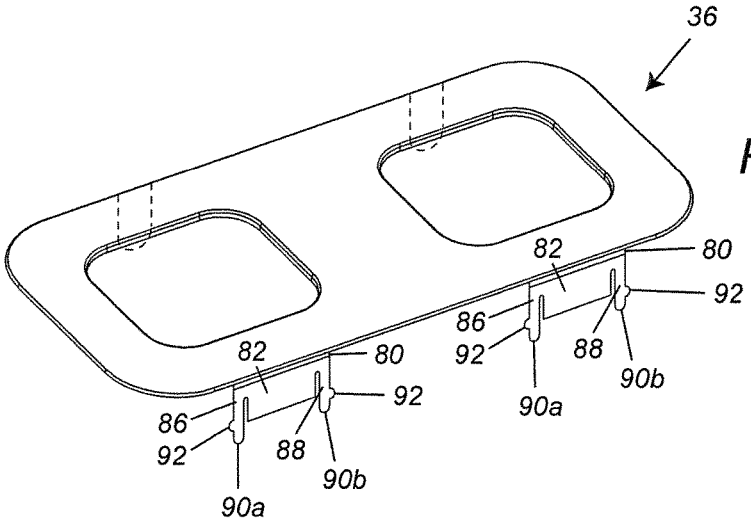
FIGS. 6A-6C depict a view of the storage receptacles and lid according to an embodiment of the invention.
Figure 6B:
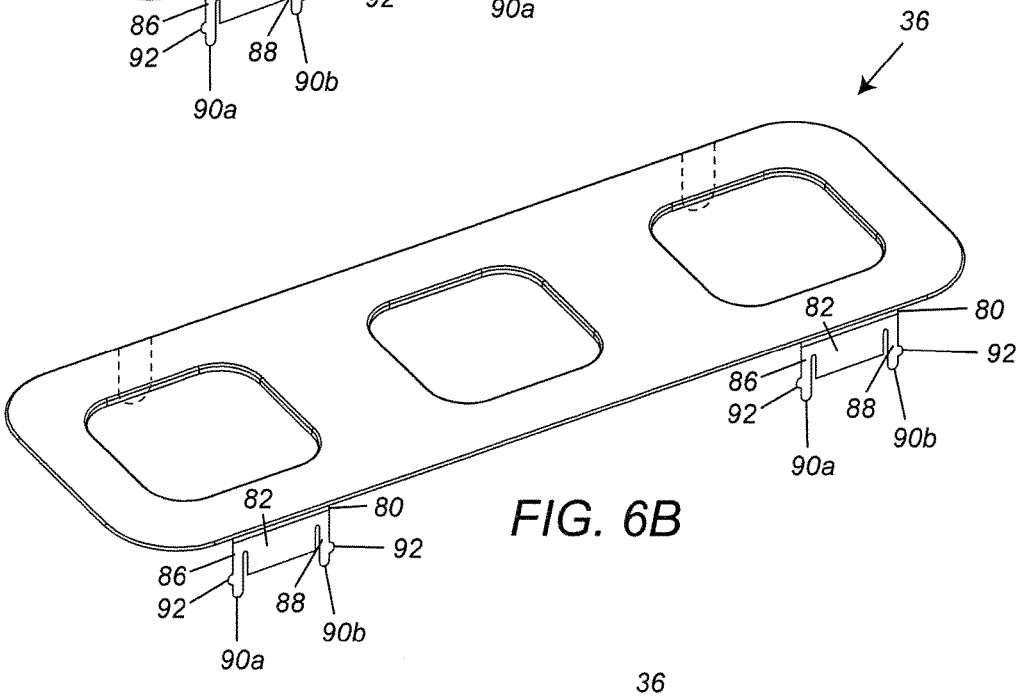
Figure 6C:
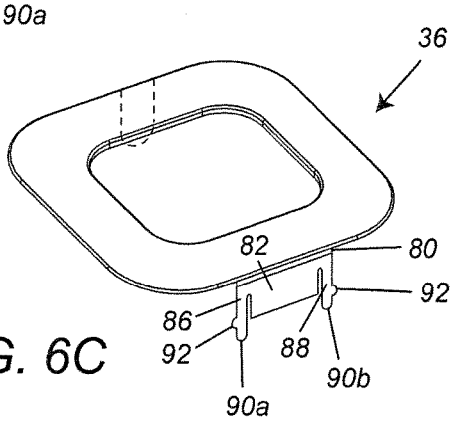

Another embodiment of the cap 36 is shown in FIGS. 6A-6C. In this embodiment, the cap 36 is removably attached to an upper edge of a side wall, front wall or back wall of the receptacle to create an enclosed receptacle. In this embodiment, the cap can be provided with one or more hinge supports 80 equally spaced along a peripheral edge of the cap. In an example the hinge includes a flap 82 configured to be received by a slot 84 (show in FIG. 7) on a sidewall 32 of the receptacle. In an embodiment, the flap 82 includes a first tab 86 opposed to a second tab 88 each of which extend outwardly and downwardly from the flap 82. The position of each tab relative to the slot 84 is configured to provide sufficient clearance to span the width of the slot 86 and in operation allow the tabs 86 and 88 to be squeezed inwards, e.g. towards the center of the flap 82 to engage the flap 82 with the slot 84. In operation, the tabs 86 and 88 can be squeezed inwards, e.g. towards the center of the flap 82 to disengage the flap 82 from the slot 84.

In an embodiment, the flap 82 and tabs 86 and 88 are integrally formed, e.g. by injection molding. The material composition and dimensions of the tabs 86 and 88 are configured that in operation, a user can laterally displace the tabs with respect to the flap 82 with moderate force and to allow the tabs 86 and 88 to return back to their original position when then force has been released. In an example the flap and tabs are composed of a resilient material such as a plastic or resilient metal.

Figure 7:
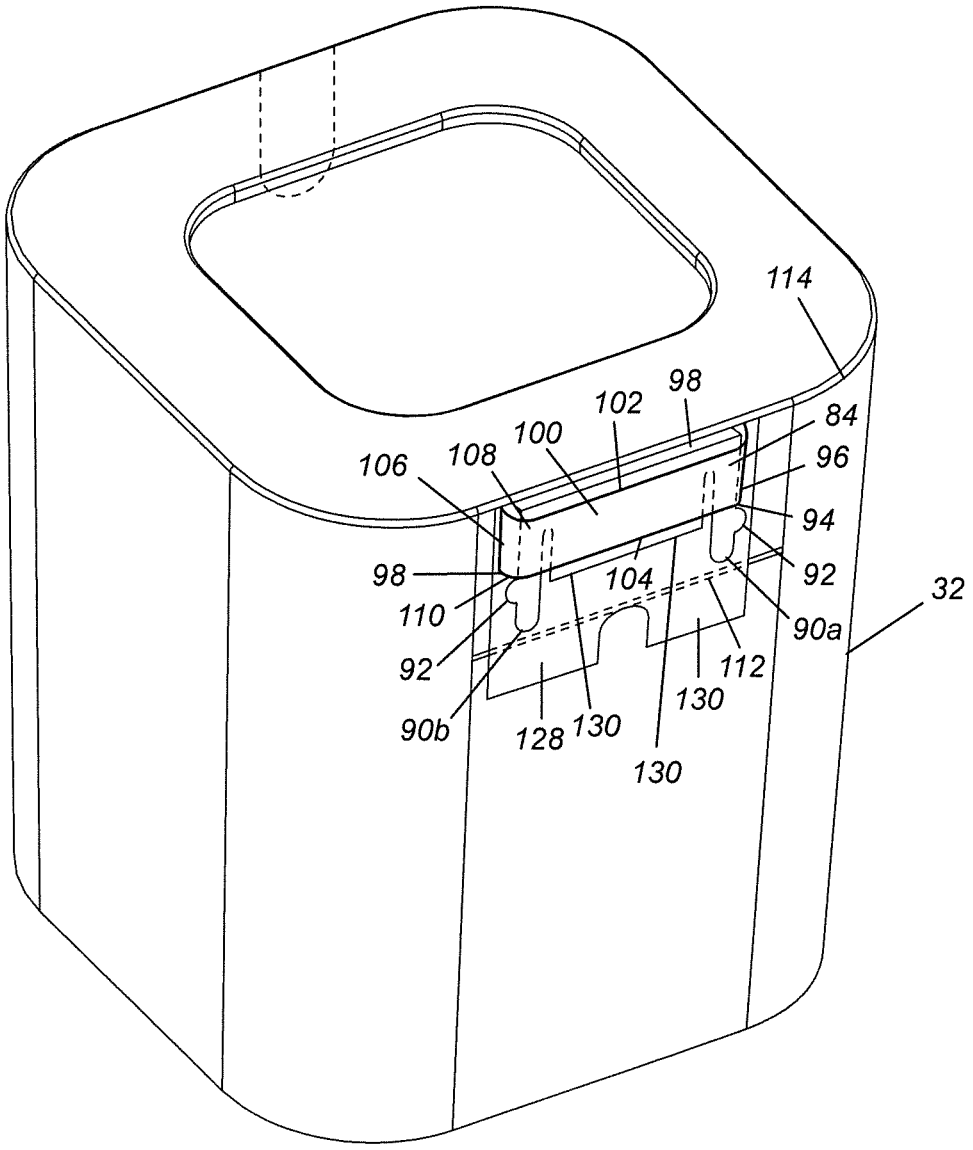
FIG. 7 depicts a view of the storage receptacle and lid according to an embodiment of the invention.

In an embodiment, each tab 86 and 88 has an end portion 90 that extends downwardly from each tab. In operation, as shown in FIG. 7, when each tab 86 and 88 is received within the slot 84, the end portion 90 extends past the lower edge 94 of the slot 84. In an embodiment, each tab 86 and 88 include a protrusion 92 that extends outwardly and horizontally from a peripheral edge of the tab. The position of each tab 86 and 88 and its respective protrusion 92 relative to the slot 84 are configured to provide sufficient clearance to span the width of the slot 86 and in operation allow the tabs 86 and 88 to be squeezed inwards, e.g. towards the center of the flap 82 to engage the flap 82 with the slot 84.

In an example, the material composition and dimensions of the tabs 86 and 88 are configured such that in operation, a user can laterally displace the tabs with respect to the flap 82 with moderate force and to allow the tabs 86 and 88 to return back to their original position when the force has been released. In this embodiment, each protrusion clears the lower edge 94 of the slot 84 when the tabs are squeezed inwards and when the force on the tabs is released, the tabs return to their original position such that the lower edge 94 of the slot rests on an upper edge 98 of the protrusions. In an example, the protrusion provides a locking mechanism that secures the flap and its respective tabs within the slot. In operation, when the flap and tabs are received within the slot 84, the protrusions prevent upward motion of the flap 82 and tabs 86 and 88. Further to this example, in operation, the tabs 86 and 88 can be squeezed inwards, e.g. towards the center of the flap 82 such that the tabs and protrusions are laterally displaced a dimension to have sufficient clearance of the slot to disengage the flap 82 from the slot 84.

In operation, the tabs 86 and 88 can be squeezed inwards, e.g. towards the center of the flap 82 to disengage the flap 82 from the slot 84.

As shown in FIG. 7, the receptacle can include one or more slots evenly spaced across the sidewall 32. In an embodiment, the slot 84 configured to receive the flap 82. The slot 84 includes a first slot end wall 96 extending outwardly and horizontally away from the receptacle sidewall 32 and terminating at an upper edge 98 and a lower edge 94. An edge of the first slot end wall 96 is coupled to a horizontal side wall 100 which faces the receptacle side wall 32 and extends horizontally across the sidewall 32 and terminates at an upper edge 102 and lower edge 104. The slot sidewall coupled to a second slot end wall 106 extending outwardly and horizontally away from the receptacle sidewall 32 and terminating at an upper edge 108 and a lower edge 110. A slot or opening formed within the slot end walls and horizontal side walls has an open top bounded by the top edges of the horizontal side walls and slot end walls and an open bottom bounded by the lower edges of the horizontal side walls and slot end walls is configured with suitable dimensions to receive a tab 86.

In an embodiment, the sidewall 32 of the receptacle includes a tab 112 that extends horizontally across a portion of the receptacle sidewall 32, downwards from the upper edge 114 and outward from the sidewall 32 of the receptacle sidewall 32. The position of the receptacle tab 112 relative to the slot 19 is configured to provide sufficient clearance to span the width of the slot 19 and in operation allow the tab to be inserted within the slot 19 and removed from the slot 19.

In an embodiment, the receptacle tab 112 includes a first receptacle tab portion 128 opposed to a second receptacle tab portion 130 each of which extend outwardly and downwardly from the tab 112. The position of each tab portion relative to the slot 19 is configured to provide sufficient clearance to span the width of the slot 19 and in operation allow the tab to be removably inserted within the slot 19.

In an embodiment, shown in FIG. 5, the partition wall includes one or more partition slots spaced evenly across the partition wall. The partition slot 19 includes a first slot end wall 116 extending outwardly horizontally away from the partition wall 18 and terminating at an upper edge 118 and a lower edge 120. An edge of the first slot end wall 116 is coupled to a horizontal side wall 122 which faces the partition wall 18 and extends horizontally across the partition wall 18 and terminates at an upper edge 118 and lower edge 120. The partition slot sidewall coupled to a second slot end wall 124 extending outwardly and horizontally away from the partition wall 18 and terminating at an upper edge 126 and a lower edge 128. A slot or opening formed within the slot end walls and horizontal side walls having an open top bounded by the top edges of the horizontal side walls and slot end walls and an open bottom bounded by the lower edges of the horizontal side walls and slot end walls is configured with suitable dimensions to receive a tab 112.

In an embodiment, the partition slot 19 has one or more interior walls that extend outward from the partition wall 18. The interior walls 130 (shown in FIG. 7) extend outward from the partition wall 18 relative to the horizontal side wall 122 to provide sufficient clearance of the tab 112 between the horizontal sidewall 122 and the interior wall. The interior walls 130 provide additional stability for the tab 112 when inserted within the partition slot 19. In an embodiment the interior walls can be further configured relative to the tab such that the spacing between the interior walls and the sidewalls or adjacent interior walls form a channel (not shown) sufficient to receive the tab 112, tab portion 128 and 130, or both.

While various embodiments of the present invention have been described, it will be apparent to those of skill in the art that many more embodiments and implementations are possible that are within the scope of this invention. Accordingly, the present invention is not to be restricted except in light of the attached claims and their equivalents.

The invention claimed is:

1. A storage system including a storage base, the storage base comprising:

a frame including (i) a first horizontal side wall facing a second horizontal side wall, (ii) a first horizontal end wall facing a second horizontal end wall, the first and second horizontal end walls extending transversely between the first and second horizontal side walls;

a partition extending transversely between the horizontal end walls to divide the frame into first and second compartments;

each of the first and second compartments including (a) a planar bottom, (b) a first vertical side wall extending up from the planar bottom and terminating at a first top edge, the first top edge coupled to the first horizontal end wall, (c) a second vertical side wall facing the first vertical side wall extending up from the planar bottom and terminating at a second top edge, the second top edge coupled to the second horizontal end wall; and a cavity formed within the planar bottom and vertical side walls of each compartment, each cavity at least having an open top bounded by the top edges of the horizontal end walls, the partition and one of the horizontal side walls;

wherein, the partition includes an upper portion extending above a level of the frame to form a handle, and the handle further includes (a) first handle portion pivotally attached to a first end of the handle, (b) a second handle portion pivotally attached to a second end of the handle, (c) and a groove configured to receive the handle portions therein, wherein the groove includes a plurality of upper edges, wherein the first handle portion and the second handle portion are configured to (1) lie flush with the upper edges when received within the groove and (2) pivot about a fixed point to a substantially 90 degree angle with respect to the handle.

2. The container system according to claim 1 wherein each of the horizontal end walls includes an opening, and each handle portion has a projecting edge configured to mate with the opening within the horizontal end walls.

3. The container system according to claim 1 wherein the horizontal side walls, horizontal end walls, partition, planar bottom and vertical end walls being integral to form a one piece, rigid base.

4. The container system according to claim 1, further comprising a plurality of removable receptacles.

5. The container system according to claim 4 further comprising differently sized removable receptacles.

6. A container system kit including:

a storage base comprising (a) a frame including (i) a first horizontal side wall facing a second horizontal side wall, (ii) a first horizontal end wall facing a second horizontal end wall, the first and second horizontal end walls extending transversely between the first and second horizontal side walls (b) a partition extending transversely between the horizontal end walls to divide the frame into first and second compartments, (c) each of the first and second compartments including (i) a planar bottom, (ii) a first vertical side wall extending up from the planar bottom and terminating at a first top edge, the first top edge coupled to the first horizontal end wall, (iii) a second vertical side wall facing the first vertical side wall extending up from the planar bottom and terminating at a second top edge, the second top edge coupled to the second horizontal end wall, and (d) a cavity formed within the planar bottom and vertical side walls of each compartment, each cavity at least having an open top bounded by the top edges of the horizontal end walls, the partition and one of the horizontal side walls; and a removable receptacle configured to be received within at least a portion of the cavities, the receptacle comprising (a) a planar bottom with side walls coupled to a plurality of outward peripheral edges of the planar bottom to form a rectangular shape, and (b) a cap in substantially a same shape as the planar bottom configured to be received by the top edges of the side walls to create an enclosed receptacle wherein, the partition of the storage base includes an upper portion extending above a level of the frame to form a handle, and the handle further includes (a) first handle portion pivotally attached to a first end of the handle, (b) a second handle portion pivotally attached to a second end of the handle, (c) and a groove configured to receive the handle portions therein, wherein the groove includes a plurality of upper edges, wherein the first handle portion and the second handle portion are configured to (1) lie flush with the upper edges when received within the groove and (2) pivot about a fixed point to a substantially 90 degree angle with respect to the handle.

* * * * *